US007719394B2

(12) United States Patent
Nelson

(10) Patent No.: US 7,719,394 B2
(45) Date of Patent: May 18, 2010

(54) LATCHING LINEAR SOLENOID

(76) Inventor: Victor Nelson, 999 Grand Blvd., Deer Park, NY (US) 11729

( * ) Notice: Subject to any disclaimer, the term of this patent is extended or adjusted under 35 U.S.C. 154(b) by 448 days.

(21) Appl. No.: 10/959,797

(22) Filed: Oct. 6, 2004

(65) Prior Publication Data

US 2006/0071748 A1 Apr. 6, 2006

(51) Int. Cl.
*H01F 7/00* (2006.01)
*H01F 7/08* (2006.01)

(52) U.S. Cl. ..... 335/229; 335/234

(58) Field of Classification Search ..... 335/229–234, 335/179
See application file for complete search history.

(56) References Cited

U.S. PATENT DOCUMENTS 2,833,968 A * 5/1958 Karlson ..... 335/234
2,950,527 A * 8/1960 Foltz ..... 29/458
3,023,330 A * 2/1962 Roters ..... 310/162
3,202,886 A * 8/1965 Kramer ..... 335/234
3,504,315 A * 3/1970 Stanwell ..... 335/234
4,071,042 A * 1/1978 Lombard et al. ..... 137/332
4,533,890 A * 8/1985 Patel ..... 335/234
4,779,582 A * 10/1988 Lequesne ..... 123/90.11
4,928,028 A * 5/1990 Leibovich ..... 310/23
5,095,856 A * 3/1992 Kawamura ..... 123/90.11
5,511,131 A * 4/1996 Kohara et al. ..... 381/396
5,883,557 A * 3/1999 Pawlak et al. ..... 335/179
6,047,672 A * 4/2000 Hanai et al. ..... 123/90.11
2006/0251286 A1 * 11/2006 Stiles ..... 381/421
2007/0201718 A1 * 8/2007 Shimoe et al. ..... 381/396

* cited by examiner

*Primary Examiner*—Ramon M Barrera
(74) *Attorney, Agent, or Firm*—Charles E. Baxley

(57) ABSTRACT

A linear solenoid includes a pair of soft iron pole members which are in a spaced apart linear arrangement. A permanent magnet is attached to the end of a plunger which rides between the pole members. When a first of two electro-magnet coils is energized the plunger which is latched to one of the pole members is repelled to the opposite pole member and latched. When the second coil is energized the plunger returns to the original pole member and is latched.

5 Claims, 14 Drawing Sheets

LATCHING LINEAR SOLENOID

FIELD OF THE INVENTION

The present invention relates generally to the field of solenoids and more particularly to a relatively small, light weight and efficient linear latching solenoid.

BACKGROUND OF THE INVENTION

The field of solenoids includes the following United States patents.

Ojima, et al. in U.S. Pat. No. 4,419,643 shows a Self-Sustaining Solenoid which includes a moving iron core which is attracted into a coil to be received by a fixed receiver. A magnetic yoke extends between the fixed receiver and the surface of the moving iron cove.

Luckenback in U.S. Pat. No. 4,327,344 shows a Solenoid with Mechanically Latchable Plunger which includes a single coil and a single armature plunger which has a latch pin. A pulse of current applied to the coil moves the armature plunger to a first retracted position and a spring biased latch latches the armature plunger. A subsequent energization of the coil unlatches the armature plunger so that the armature plunger is returned to the original position by a spring.

Fuzzell in U.S. Pat. No. 4,494,096 shows a Latching Solenoid which includes a first coil which positions a member at a preselected location where it is locked by a mechanical latch. The latch includes a movable plunger which engages an end portion of the member. Inserting the plunger into the member radically expands the end portion and captures the end portion between the plunger and the wall of a bore. A second coil withdraws the plunger and releases the member from the latched position.

Kelly in U.S. Pat. No. 4,613,176 shows a Door Latch Mechanism which has a pivoted latch which is disposed between a retaining solenoid and a four-bar toggle linkage. The toggle linkage connects an operating stem of the retaining solenoid to a latch. The linkage provides a mechanical advantage to amplify the holding force of the solenoid. When the solenoid is de-energized and pressure is applied to open the door, the latch pivots and the linkage collapses to release a keeper bar.

Green, Jr. in U.S. Pat. No. 4,752,487 shows a Double Acting Permanent Magnet Latching Solenoid which is driven by reversal of coil current and held in place by a permanent magnet. The permanent magnet is located in a space between two coils. The device includes conical ends on the solenoid plunger and conical interiors matching the conical ends.

Laffey in U.S. Pat. No. 5,808,534 shows a Solenoid Frame and Method of Manufacture which includes a frame with interlocking tabs and a locking mechanism for fastening the frame and pieces.

Hines in U.S. Pat. No. 5,365,210 shows a Latching Solenoid with Manual Override which includes a manually translatable member which can be moved to vary the reluctance in a magnetic circuit.

Cascolan, et al. in U.S. Pat. No. 6,265,956 shows a Permanent Magnet Latching Solenoid which includes a bushing which is press-fit in each of the ends of a bobbin. A magnetically permeable frame surrounds the bobbin and openings in the ends of a frame accommodate passage of an operator rod which is attached to an armature. Brief pulsing of a coil on the bobbin creates an opposing magnetic field which temporarily opposes the magnetic field on the first end of the frame and creates an attractive field at the opposite end of the frame thereby impelling the armature from a first end position to a second end position.

Ruan, et al. in U.S. Patent Application Publication US 2003/0137374 A1 shows Micro-Magnetic Latching Switches with a three-dimensional solenoid coil which includes a moveable cantilever which has a magnetic material. The cantilever includes a conducting layer. A permanent magnet induces magnetization in the magnetic material and a solenoid produces a second magnetic field to switch the cantilever between a first stable state and a second stable state.

Despite the developments of the prior art there remains a need for a relatively small light-weight linear latching solenoid.

OBJECTS AND SUMMARY OF THE INVENTION

IT IS AN OBJECT of the present invention to provide a latching linear solenoid which is relatively small in overall size.

ANOTHER OBJECT of the present invention is to provide a latching linear solenoid which is relatively light in weight.

ANOTHER OBJECT of the present invention is to provide a latching linear solenoid which is efficient in the use of electrical power.

ANOTHER OBJECT of the present invention is to provide a linear solenoid with an adjustable plunger displacement.

ANOTHER OBJECT of the present invention is to provide a linear solenoid wherein the latching force at the end stops may be varied.

ANOTHER OBJECT of the present invention is to provide a linear solenoid having a pair of plungers which are capable of parallel motion.

ANOTHER OBJECT of the present invention is to provide a linear solenoid having a pair of plungers which are capable of see-saw like motion.

YET ANOTHER OBJECT of the present invention is to provide a latching linear solenoid which comprises a relatively small number of component parts each of which can be manufactured economically resulting in a relatively low unit cost.

THE FOREGOING AND OTHER OBJECTS AND ADVANTAGES of the invention will appear more clearly hereinafter.

In accordance with the present invention there is provided a latching linear solenoid a first embodiment of which includes a pair of soft iron pole pieces which are in a spaced apart linear alignment and contained within a bobbin. A first coil and a second coil are disposed on the bobbin with each of the coils disposed proximate to one of the pole pieces. A permanent magnet is attached to the end of a plunger which rides in the bobbin. When the coils are de-energized, the plunger is latched to one of the soft iron poles. When the first coil is energized, the plunger is repelled to the opposite pole and latched. When the second coil is energized magnetic forces are created to return the plunger to the first position.

A second embodiment of the invention includes a single coil mounted on a bobbin. Permanent magnets are mounted on opposite ends of a plunger which projects beyond the ends of the bobbin. When current is reversed in the coil, the permanent magnets drive the plunger from a first latched position to a second latched position.

A third embodiment of the invention is similar to the second embodiment with the coil having two portions and with the addition of third permanent magnet which is mounted on the plunger between the two portions of the coil. The addition of a third permanent magnet generates additional latching and drive force when compared to the second embodiment.

A fourth embodiment of the invention provides a fail safe device which requires current to stay in the energized position and which returns to the de-energized position when current is removed without the need for a return spring.

A fourth embodiment of the invention is similar to the second embodiment of the invention with the exception that one of the two permanent magnets of the second embodiment is removed. When current is applied to the coil the permanent magnet is repelled and moves away from the soft iron pole.

A fifth embodiment of the invention includes a magnetic shield which contains the magnetic flux produced by the apparatus resulting in improved performance.

A sixth embodiment of the invention utilizes a soft iron core member which has the overall configuration of a capital letter C.

A seventh embodiment of the invention is similar to the sixth embodiment of the invention with the addition of a second coil which can be used to control the direction of motion of the plunger.

The eighth, ninth embodiments and tenth embodiments of the invention include a pair of permanent magnet assemblies each of which is mounted on a plunger. The plungers are capable of parallel motion and see-saw like motion. The permanent magnet assemblies each include a pair of permanent magnets and a separator.

An eleventh embodiment of the invention is similar to the second embodiment of the invention with the exception that a second coil has been added to control the direction of motion of the plunger.

A twelfth and thirteenth embodiment of the invention include a pair of plungers, a pair of permanent magnets and a pair of individual pole members which support pair of coils.

BRIEF DESCRIPTION OF THE DRAWING

Other important objects and advantages of the invention will be apparent from the following detailed description, taken in connection with the accompanying drawings in which.

DETAILED DESCRIPTION OF THE INVENTION

Figure 1:
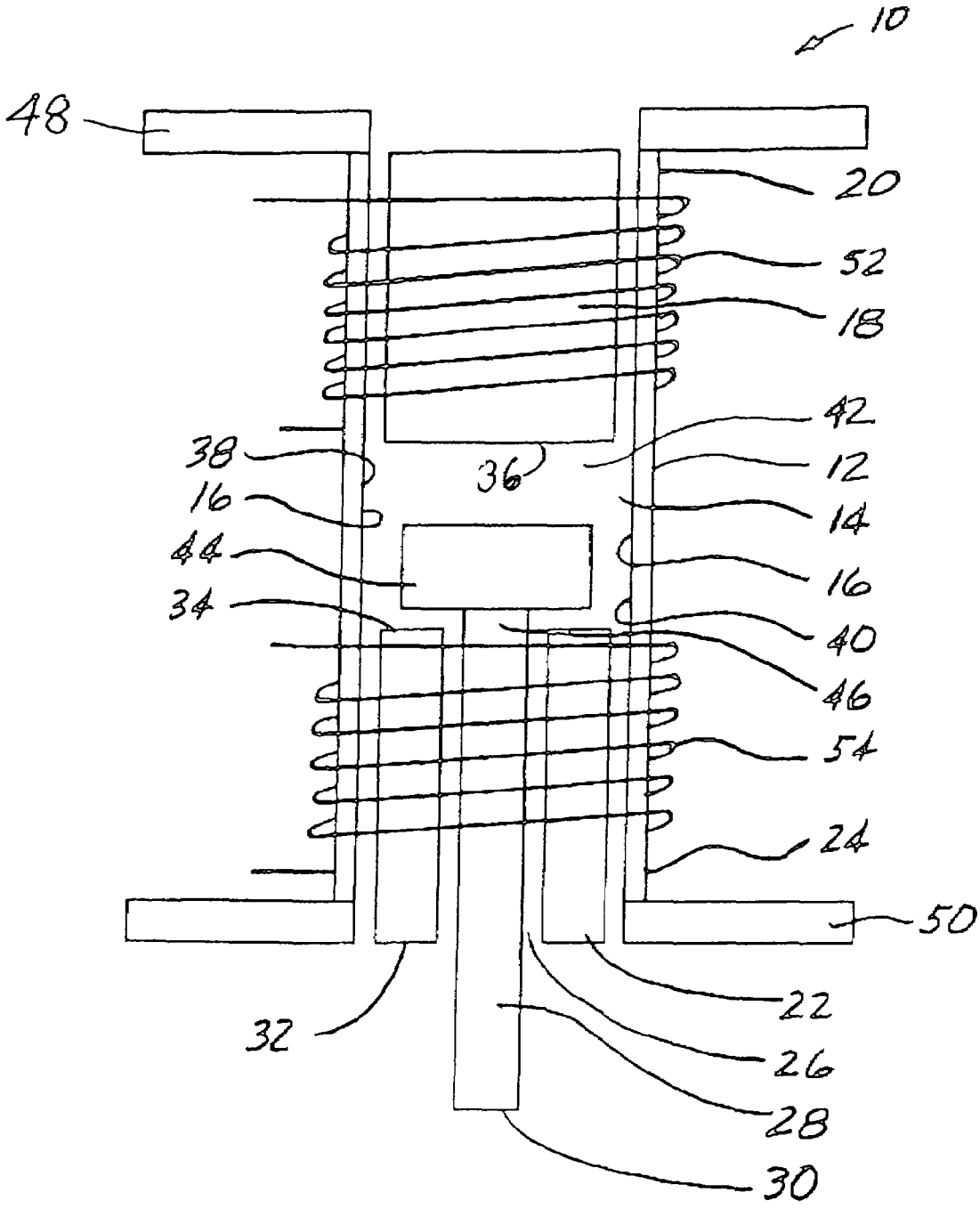
FIG. 1 is a schematic view of a first embodiment of a linear solenoid made according to the present invention.

With reference to the drawings there is shown in FIG. 1, a first embodiment of the present invention 10 which includes a hollow bobbin 12 which has an internal cavity 14 which is defined by the inner wall portions 16. A first pole member 18 which is preferably made of a magnetically permeable material such as soft iron is mounted in the cavity 14 adjacent to the first end 20 of the bobbin 12.

A second pole member 22 which is also made of a magnetically permeable material is mounted in the cavity 14 adjacent to the second end 24 of the bobbin 12. The second pole member 22 has a central base 26 which supports a plunger 28 in a sliding relationship. As is shown in FIG. 1, the first end 30 of the plunger 28 projects past the end 32 of the second pole member 22 and the end 24 of the bobbin 12.

The inner ends 34, 36 of the first and second pole members 18, 22 are spaced apart, and the first and second pole members 18, 22 and the inner wall portions, 38, 40 define an operating cavity 42. A plunger magnet 44, which is a permanent magnet is disposed within the operating cavity 42 and is attached to the second end 46 of the plunger 28.

The first and the second ends 20, 24 of the bobbin 12 are connected to flange members 48, 50. A first coil 52 is wound on the bobbin 12 adjacent to the first end 20 of the bobbin 12 generally in alignment with the first pole member 18. A second coil 54 is wound on the bobbin 12 adjacent to the second end 24 of the bobbin 12 and generally in alignment with the second pole member 22.

When the first coil 52 and the second coil 54 are de-energized the plunger 28 is latched to either the first 18 or to the second 22 pole member as a result of magnetic attraction between the plunger magnet 44 and the soft iron pole members 18, 22. As shown in FIG. 1, the plunger magnet 44 is attracted to the second pole member 22 and the plunger 28 is latched. When the second coil 54 is energized the plunger magnet 44 is repelled from the position shown in FIG. 1 and the plunger magnet 44 moves to contact end 36 of the first pole member 18.

When the first coil 52 is energized the plunger magnet 44 is repelled away from the first pole member 18 and returns to contact end 34 of the second pole member 22 and the plunger 28 is again latched to the second pole member 22.

Figure 2:
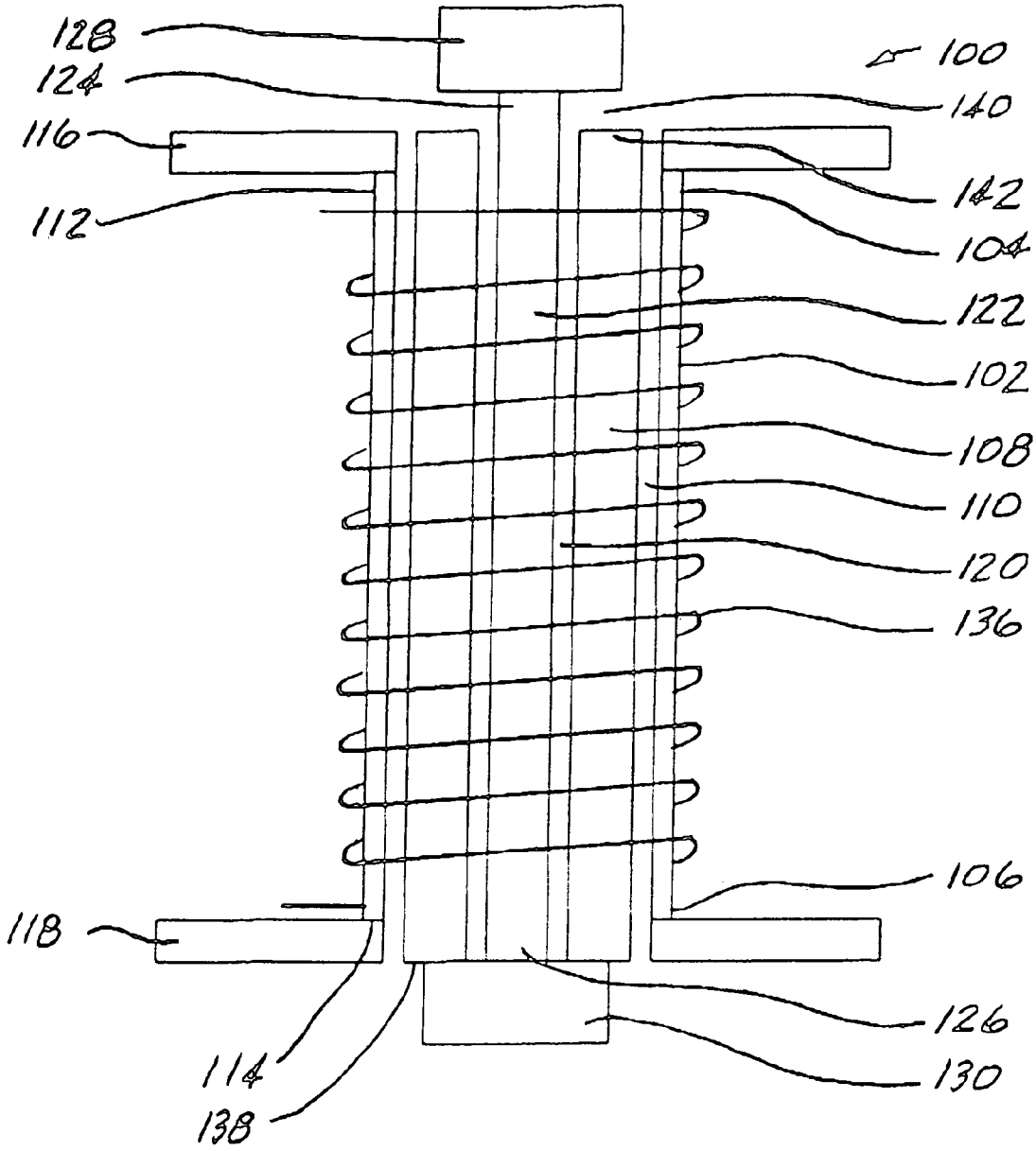
FIG. 2 is a schematic view of a second embodiment of the present invention.

FIG. 2, shows a second embodiment of the invention 100 which includes a hollow bobbin 102 which has a first end 104 and a second end 106. A magnetically permeable pole member 108 which preferably may be made of soft iron is mounted in the cavity 110 of the hollow bobbin 102. The ends 112, 114 of the bobbin 102 are attached to flange members 116, 118.

The pole member 108 includes a central bore 120 which supports a plunger 122 in a sliding relationship. The ends 124, 126 of the plunger 122 can project past the flange members 116, 118. Permanent magnets 128, 130 are attached, one each, to the ends 124, 126 of the plunger 122.

A coil 136 is wound on the bobbin 102. Application of current to the coil 136 creates a magnetic flux which attracts the permanent magnet 130 to the end 138 of the pole member 108 as is shown in FIG. 2 and repels magnet away from end 142. In the state shown in FIG. 2 there is a gap 140 between the magnet 128 and the end 142 of the pole member 108. The state shown in FIG. 2 is defined as the first state. When the current applied to the coil 136 is reversed, the magnet 128 is attracted to the end 142 of the pole member 108 and the magnet 120 comes into contact with the end 142 of the pole member 108 and is latched and the magnet 170 is repelled away from end 138 thereby forming a configuration which is defined as the second state, which has not been illustrated. In the second state the magnet 128 is in contact with the end 142 of the pole member 108 and 15 latched. In the second state there is a gap between the magnet 130 and the end 138 of the pole member 108.

When the direction of the applied current is again reversed the apparatus 100 again is driven to the first state, as previously described.

Figure 3:
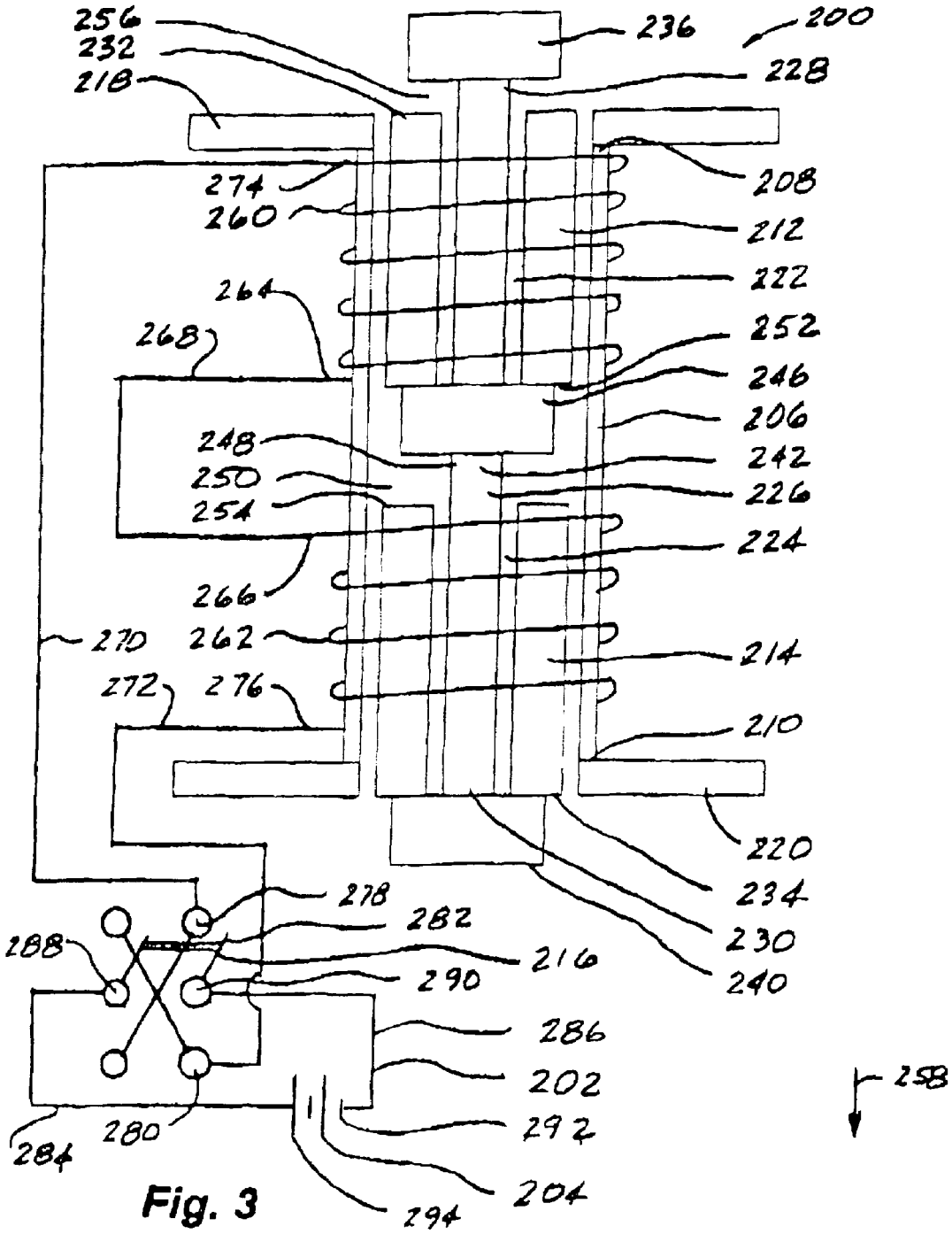
FIG. 3 is a schematic view of a third embodiment of the present invention.

FIG. 3, is a schematic diagram of a third embodiment 200 of the invention with the third embodiment 200 shown connected to a circuit 202 which includes a battery 204 and a switch 216 which reverses the direction of the current in the circuit 202. The switch is preferably a double-pole-double-throw switch.

The third embodiment 200 includes a hollow bobbin 206 which has a first end 208 and a second end 210. A first magnetically permeable pole member 212 is mounted within the bobbin 206 adjacent to the first end 208 and a second magnetically permeable pole member 214 is mounted within the bobbin 206 adjacent to the second end 210. The ends 208, 210 of the bobbin 206 are attached to flange members 218, 220.

The pair of magnetically permeable pole members 212, 214 preferably may be made of soft iron. The first and second pole members 212, 214 each include a central bore 222, 224 which support a plunger 226 member in a sliding relationship. The first and the second end 228, 230 of the plunger 226 can project past the ends 208, 210 of the bobbin 206 as shown in FIG. 3. The first and second pole members 212, 214 have ends 232, 234, respectively.

A first permanent magnet 236 mounted on the first end 228 of the plunger 226 and a second permanent magnet 240 is mounted on the end 230 of the plunger 226.

A third permanent magnet 246 mounted on an intermediate portion 246 of the plunger 226. As is shown in FIG. 3 there is a gap 250 between the ends 252, 254 of the first and the second pole members 212, 214. The permanent magnets 236, 240, 246 are mounted on the plunger 226 in a spaced relationship such that when the second magnet 240 is in contact with the 234 of the pole member 214 the third magnet 246 is in contact with the end 252 of the first pole member 212 and there is a gap 256 between the first magnet 236 and the end 232 of the first pole member 212. The contact between the magnets 240, 246 and the poles 212, 214 creates a first latched condition.

When the plunger 226 moves in the direction shown by the arrow 253 in FIG. 3 the first magnet 236 contacts the first pole 212 member, the third magnet 246 contacts the second pole member 214 and there is a gap (not illustrated) between the first pole 212 and the third magnet 240 thereby creating a second latched condition.

The third embodiment 200 includes a first coil 260 which is mounted on the bobbin 206 adjacent to the first pole member 212 and a second coil 262 is mounted on the bobbin 206 adjacent to the second pole member 214. The first and the second coils 260, 262 have the same direction of winding as is shown in FIG. 3 and the ends 264, 266 of the first and the second coils 260, 262 are connected by an electrical connecting line 268. The electrical circuit 202 includes lines 270, 272 which connect the ends 274, 276 of the first and the second coils 260, 262 to the terminals 278, 280 of the switch 282, respectively. Lines 284, 286 connect the terminals 288, 290 of the switch 282 to the positive and negative terminals, 292, 294 of the battery 204, respectively.

The operation of the third embodiment of the invention 200 shown in FIG. 3 is similar to the operation of the embodiment of the invention 100 shown in FIG. 2. Reversal of the direction of the current in the circuit 202 causes a reversal in the direction of motion of the plunger 226 and causes the embodiment 200 to latch at the end of the travel of the plunger 226 as described above in either the first latched condition or in the second latched condition under the control of the switch 282.

The addition of the third magnet 246 in the third embodiment of the invention 200 generates additional latching and driving force when compared with the second embodiment of the invention 100.

Figure 4:
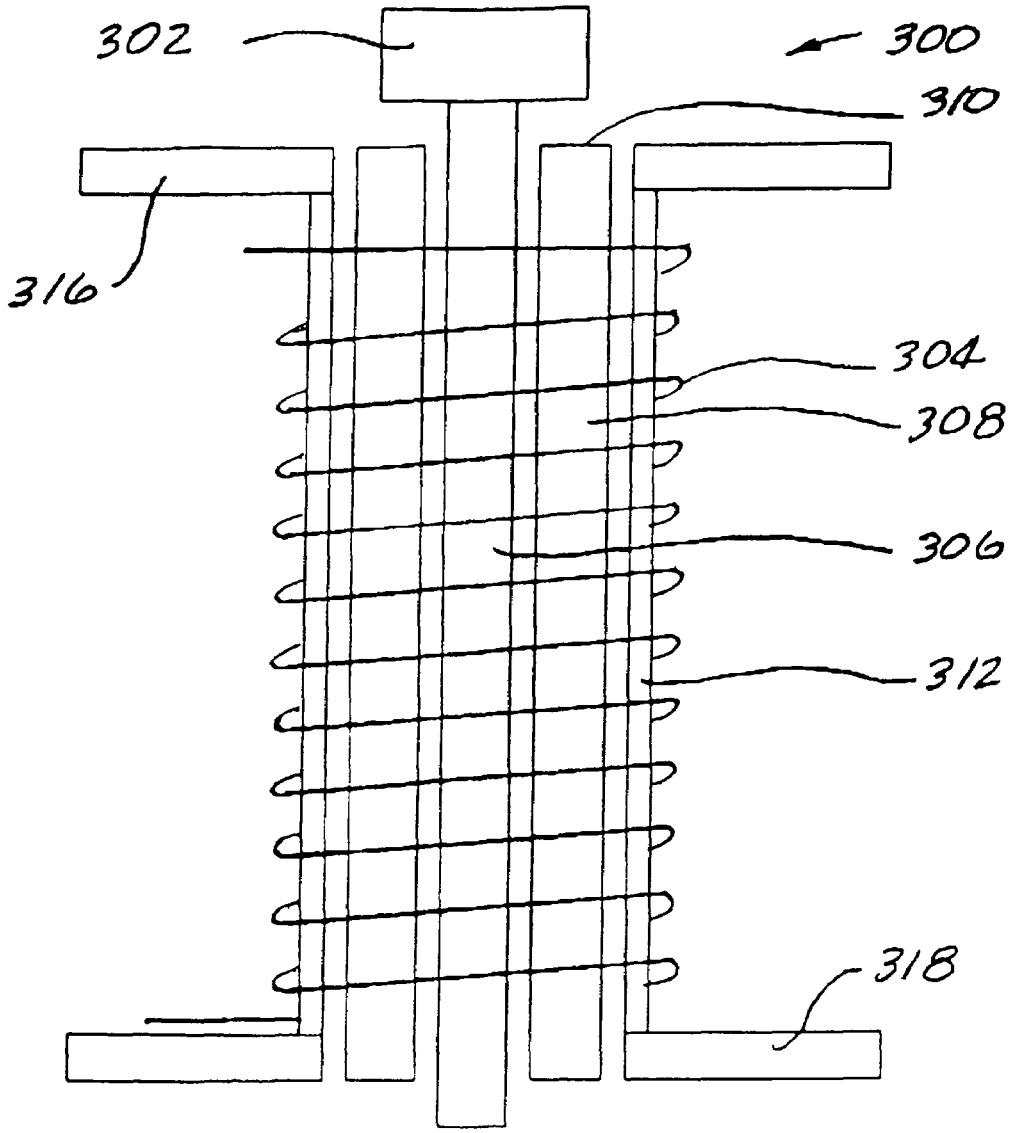
FIG. 4 is a schematic view of a fourth embodiment of the present invention.

FIG. 4 shows a fourth embodiment of the invention 300 which is generally similar to the second embodiment 100 of the invention which has been described in connection with FIG. 2.

In the fourth embodiment of the invention 300 only a single permanent magnet 302 which is similar to the two permanent magnets 128, 130 shown in FIG. 2 is utilized. The fourth embodiment of the invention 300 functions as a fail-safe solenoid which requires current in order to stay in the energized position. When the current is removed from the coil 304 the plunger 306 returns to the de-energized position in which the magnet 202 is in contact with the end 310 of the pole members 308 which is mounted in the hollow bobbin 312. When the current is applied to the coil 304 which is disposed on the bobbin 312 the magnet 302 is repelled away from the pole member 308. The bobbin 312 is connected to flange members 316, 318.

Removing the current causes the permanent magnet 302 to return to the pole member 308 and to continue to remain latched to the pole member 308 until current is applied. The fail-safe action of the fourth embodiment 300 does not require a mechanical spring thereby eliminating a source of failure which would ordinarily adversely impact the reliability of prior art units.

The various bobbins 12, 102, 206, 312 in the above embodiments of the invention 10, 100, 200, 300 are generally cylindrical in configuration and the various flange members 48, 50, 116, 118, 218, 220, 316, 318 which are attached to the bobbins preferably include conventional mounting provisions such as mounting holes for attachment to supporting structures.

Figure 5:
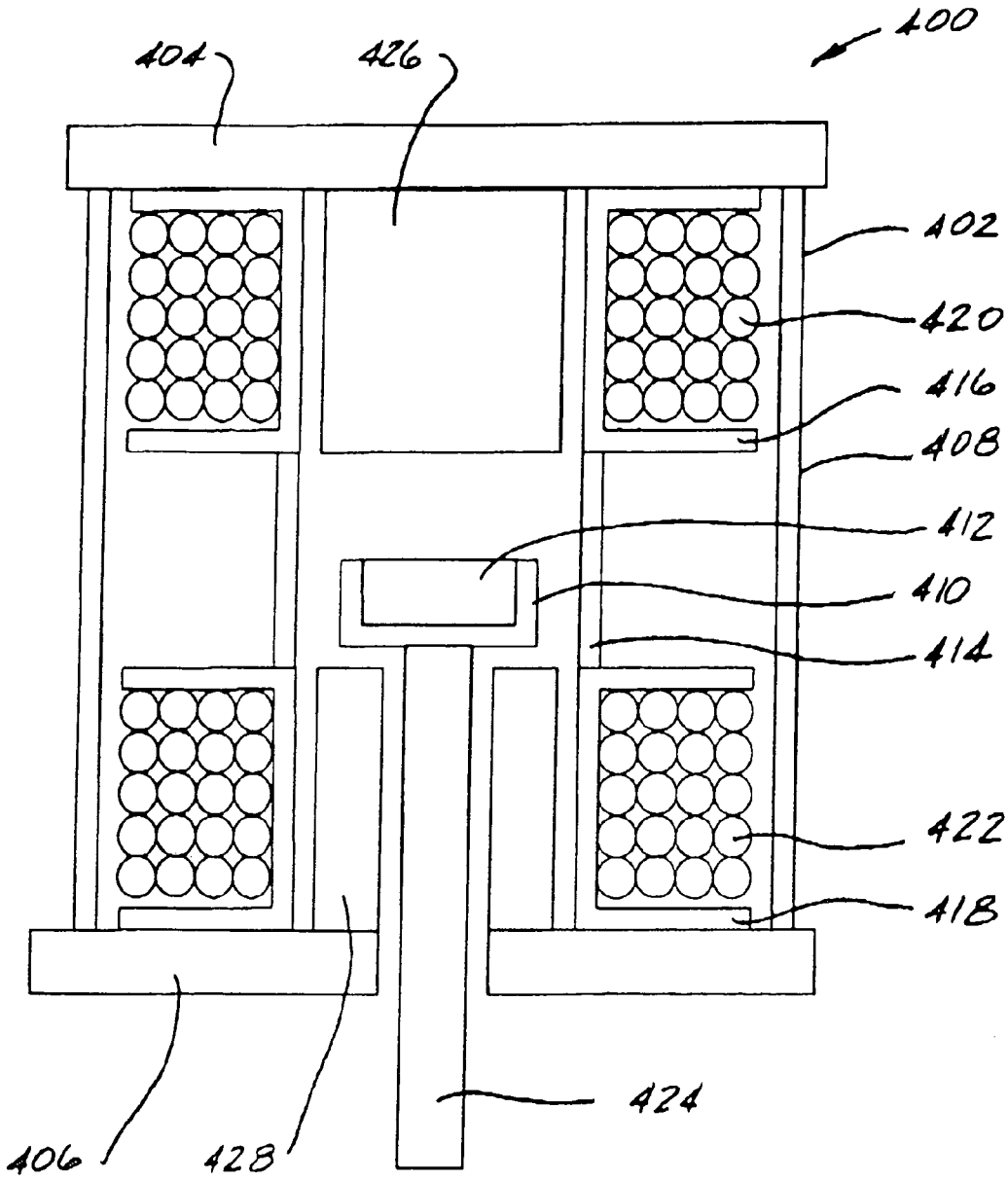
FIG. 5 is a schematic view of a fifth embodiment of the present invention.

FIG. 5 shows a fifth embodiment 400 which is generally similar to the embodiment 10 of FIG. 1 with the addition of a magnetic shield 402 which encloses and shields the apparatus 400. The magnetic shield 402 is preferably made of soft iron as are the top and bottom pole plates 404, 406. The total magnetic flux is contained within the shield 408 formed by the top and bottom pole plates 404, 406 and the shield 402 and there is resulting improvement in performance as compared with the embodiment of FIG. 1.

FIG. 5 shows additional details of construction including a cup-shaped member 410 which holds the permanent magnet 412 and the spacer 414 which maintains the position of the bobbins 416, 418 which support the coils 420, 422. The embodiment 400 includes a plunger 424 a first pole member 426 and a second pole member 428.

The operation of the embodiment 400 is the same as has been previously described in connection with FIG. 1.

The magnetic shield 408 shown and described in connection with FIG. 5 can also be applied to the embodiments shown in FIGS. 1-4 and 6-14.

Figure 6:
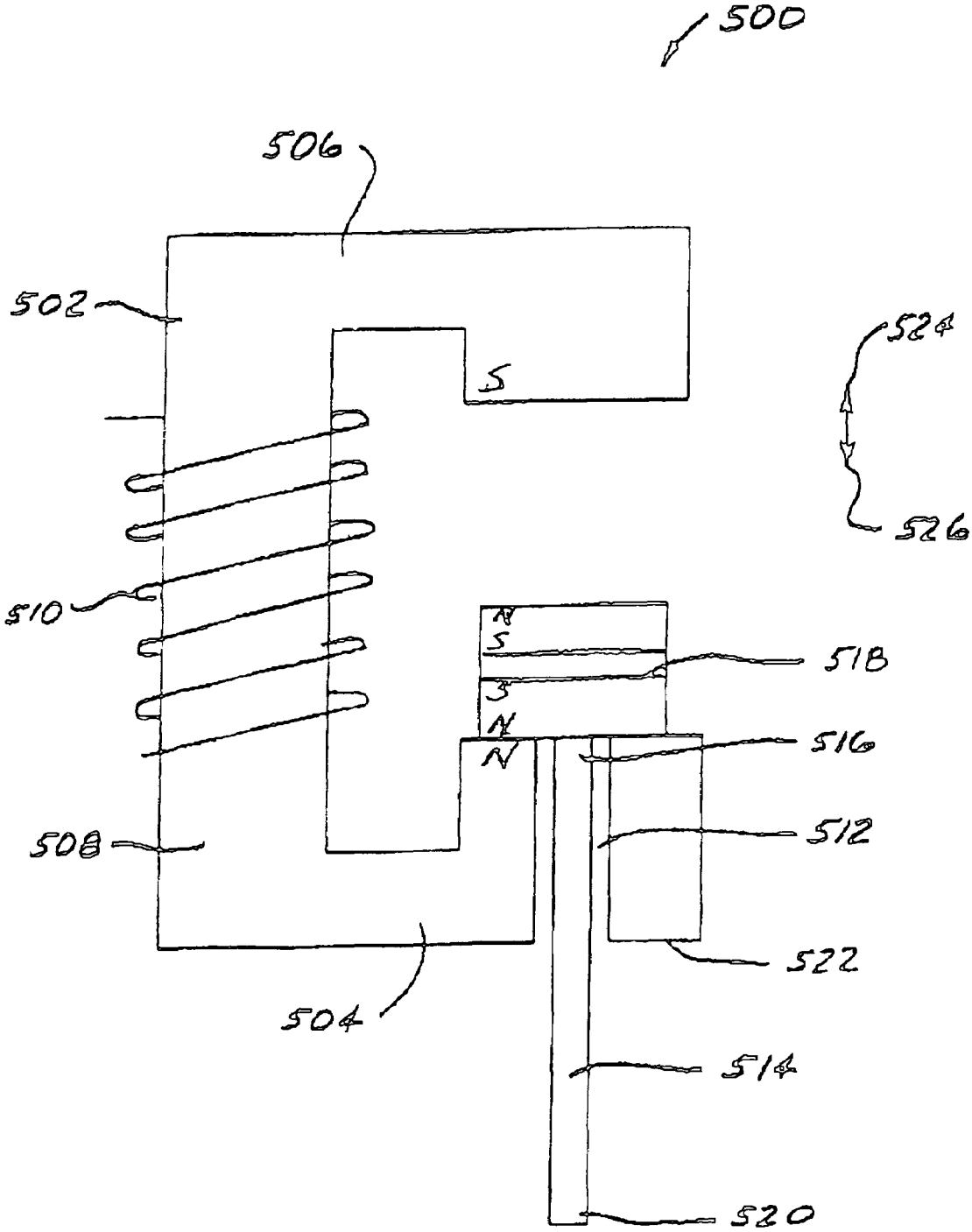
FIG. 6 is a schematic view of a sixth embodiment of the present invention.

FIG. 6 shows a sixth alternative embodiment of the invention 500 which includes a soft iron core member 502. The soft iron core member 502 has the general overall configuration of a capital letter C which includes a pair of generally horizontal portions 504, 506 which are each connected to a vertical portion 508. The vertical portion 508 has a coil 510 wound thereon which forms an electromagnet when the coil 510 is energized. The lower horizontal member has a through hole 512 which supports a plunger 514 in a sliding relationship.

The upper end 516 of the plunger 514 is connected to a permanent magnet assembly 518. The lower end 520 of the plunger 514 projects beyond the surface 522 of the horizontal portion 504.

When the coil 510 is energized a magnetic field is created in the area between the horizontal portions 504, 506 of the core member 502. The magnetic field interacts with the magnetic flux produced by the permanent magnet assembly 518 thereby causing the permanent magnet 518 and the plunger 514 to move in the directions shown by the arrows 524, 526 in FIG. 6. When the coil 510 is de-energized, the permanent magnet assembly 516 is attracted to the soft iron core 502 thereby forming a latched condition as shown in FIG. 6.

The details of construction of the permanent magnet assembly 518 are identical to the permanent magnet assembly 702, 704. The permanent magnet assemblies 702, 704 will be described in detail presently in connection with FIGS. 8 and 9.

Figure 7:
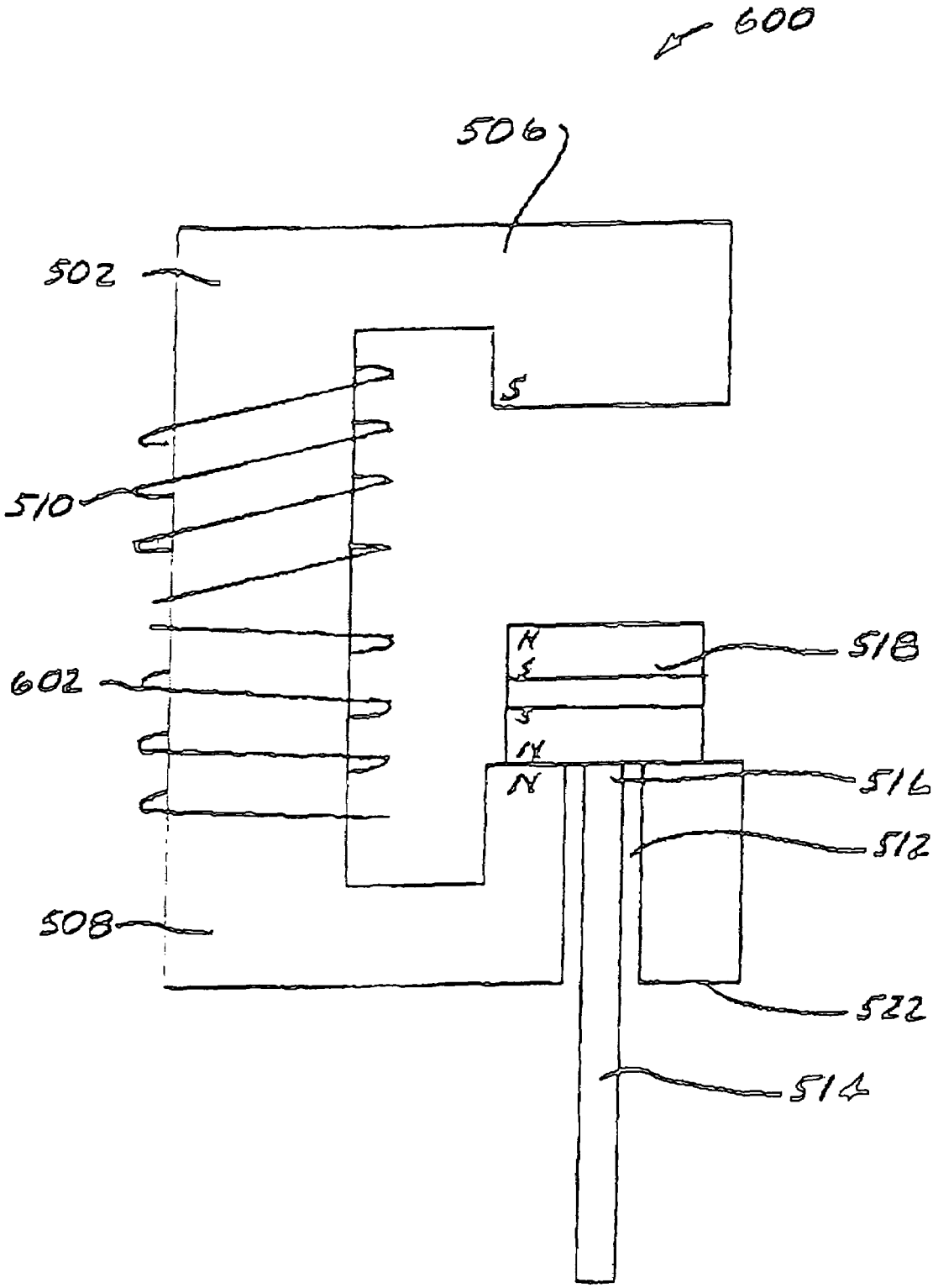
FIG. 7 is a schematic view of a seventh embodiment of the present invention.

In the seventh embodiment of the invention 600 which is shown in FIG. 7 a second coil 602 of opposite hand to the coil 510 is wound on the vertical portion 508 of the soft iron core 502. The direction of motion of the plungers 514 may be accomplished selectively by selective energization of a selected one of the two coils 510, 602.

Figure 8:
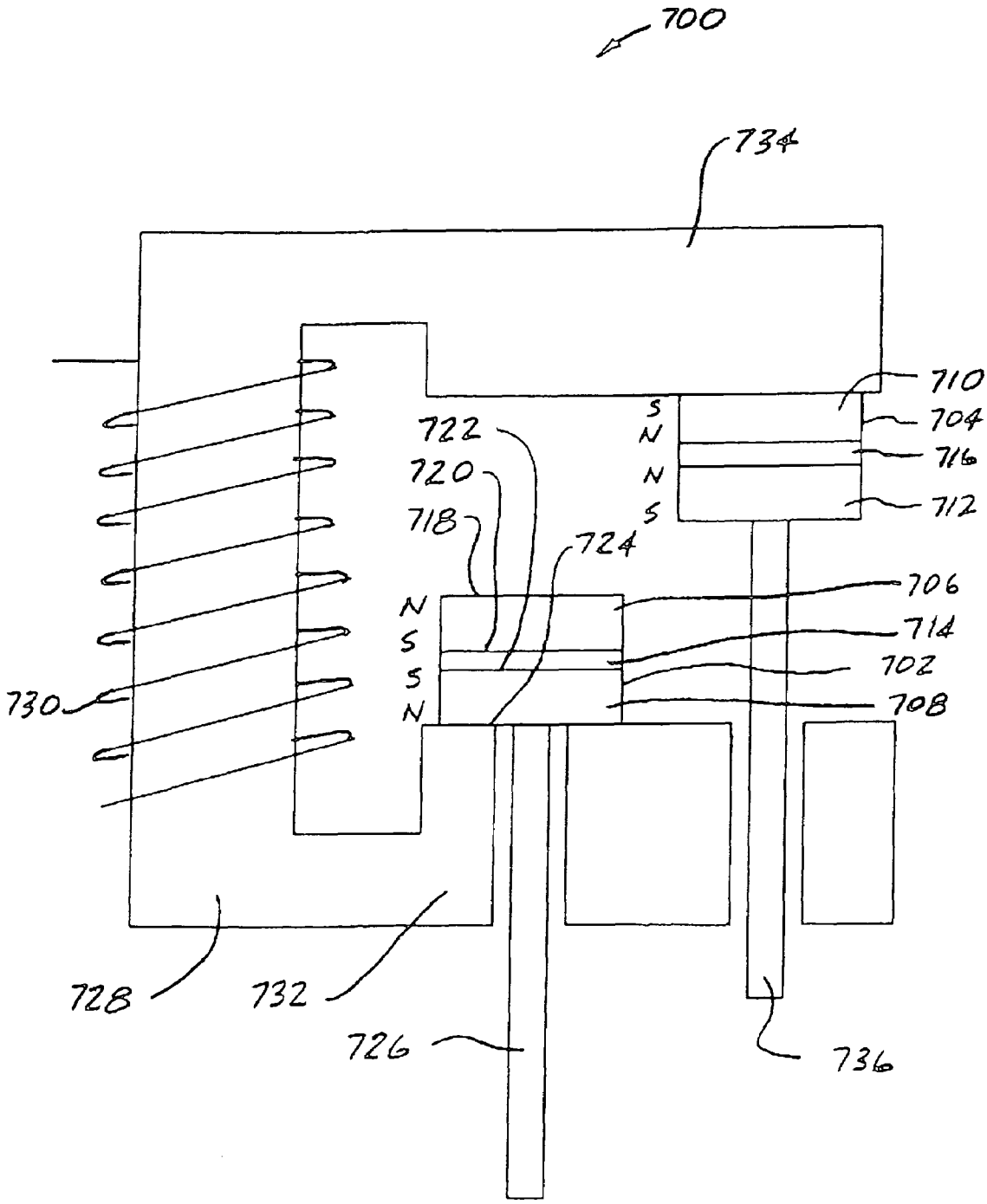
FIG. 8 is a schematic view of an eighth embodiment of the present invention.
Figure 9:
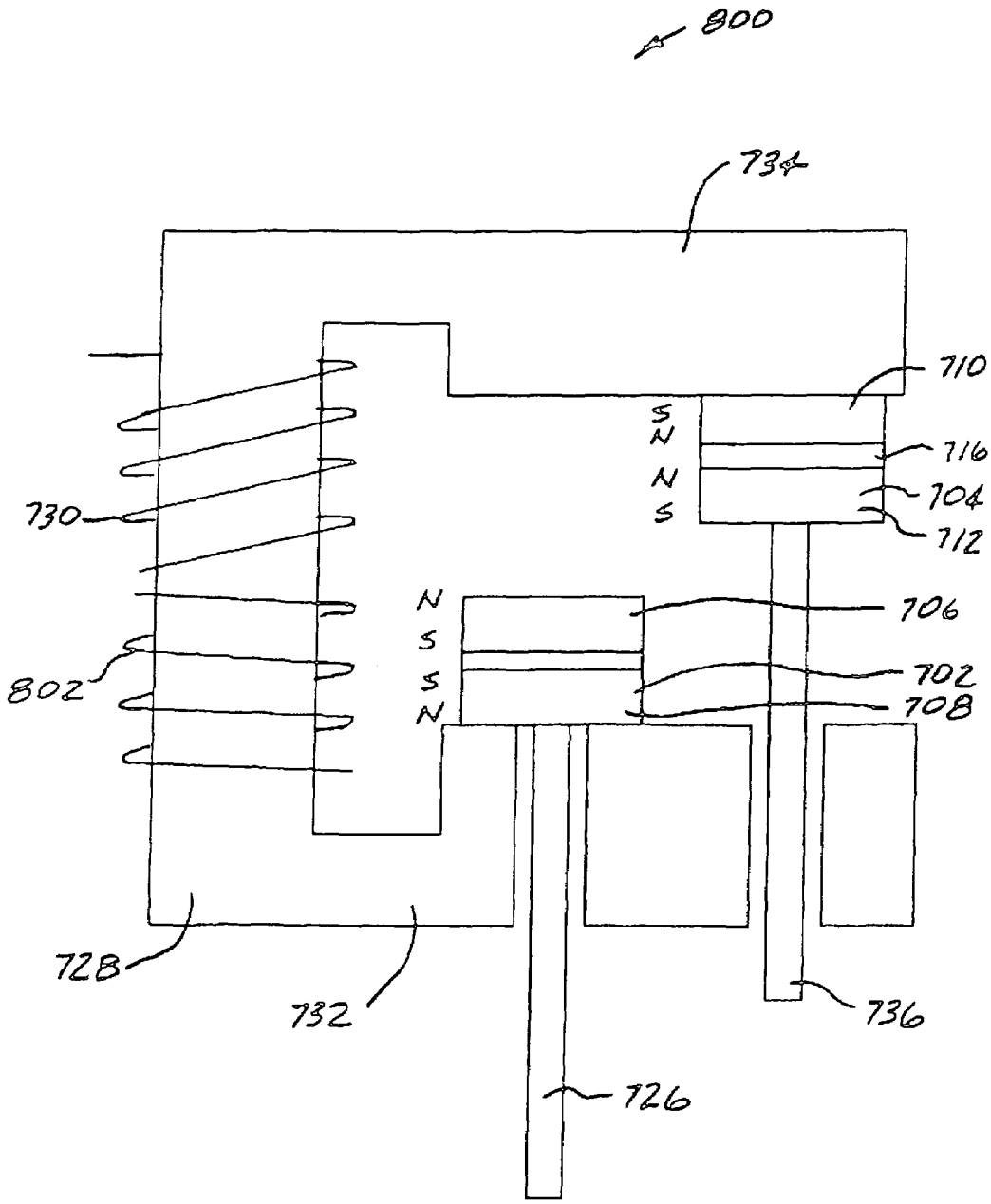
FIG. 9 is a schematic view of a ninth embodiment of the present invention.

The eighth and ninth embodiments 700 and 800 which are shown in FIGS. 8 and 9 each includes a pair of permanent magnet assemblies 702, 704. The permanent magnet assemblies 702, 704 each include a pair of permanent magnets 706, 708, 710, 712 and a separator 714, 716. The separators 714, 716 are made of a magnetic material such as soft iron. The permanent magnets 706, 708 and the separator 714 are arranged in a vertical array with the upper surface 718 of the first magnet 706 forming a North pole, designated by the letter N in FIG. 8. The lower surfaces 720 of the first magnet forms a South pole designated by the letter S in FIG. 8. The lower surface 720 of the first magnet is in contact with the separator 714. The upper surface 722 of the second magnet 708 forms a South pole and is in contact with the separator 714. The lower surface 724 of the second 708 magnet forms a North pole.

The magnetic assembly 702 thus has back-to-back magnets 706, 708 which are in contact with a magnetic separator 714. The magnetic assemblies 702, 704 are connected to plungers 726, 736, respectively. The magnetic assembly 704 shown in FIG. 8 is similar to magnetic assembly 702 in construction, but of opposite polarity.

When the two magnetic assemblies 702, 704 are assembled with the soft iron core member 728 as is shown in FIG. 8. The energization of the single coil 730 with current flowing in a first direction causes a see-saw effect in which the first assembly 702 is driven to the lower horizontal portion 732 while the second assembly 704 is driven to the upper horizontal portion 734. Reversing the direction of the current in the coil 730 causes a reversal in the positions of first 702 and the second 704 assemblies, with the assembly 702 driven to the upper horizontal position 734 and the second assembly 704 driven to lower horizontal position 734 thus accomplishing a see-saw motion.

Alternatively, as is shown in FIG. 9 the need to reverse the direction of the current can be eliminated through the incorporation of a second coil 802 which is wound in opposite hand to the coil 730.

Figure 10:
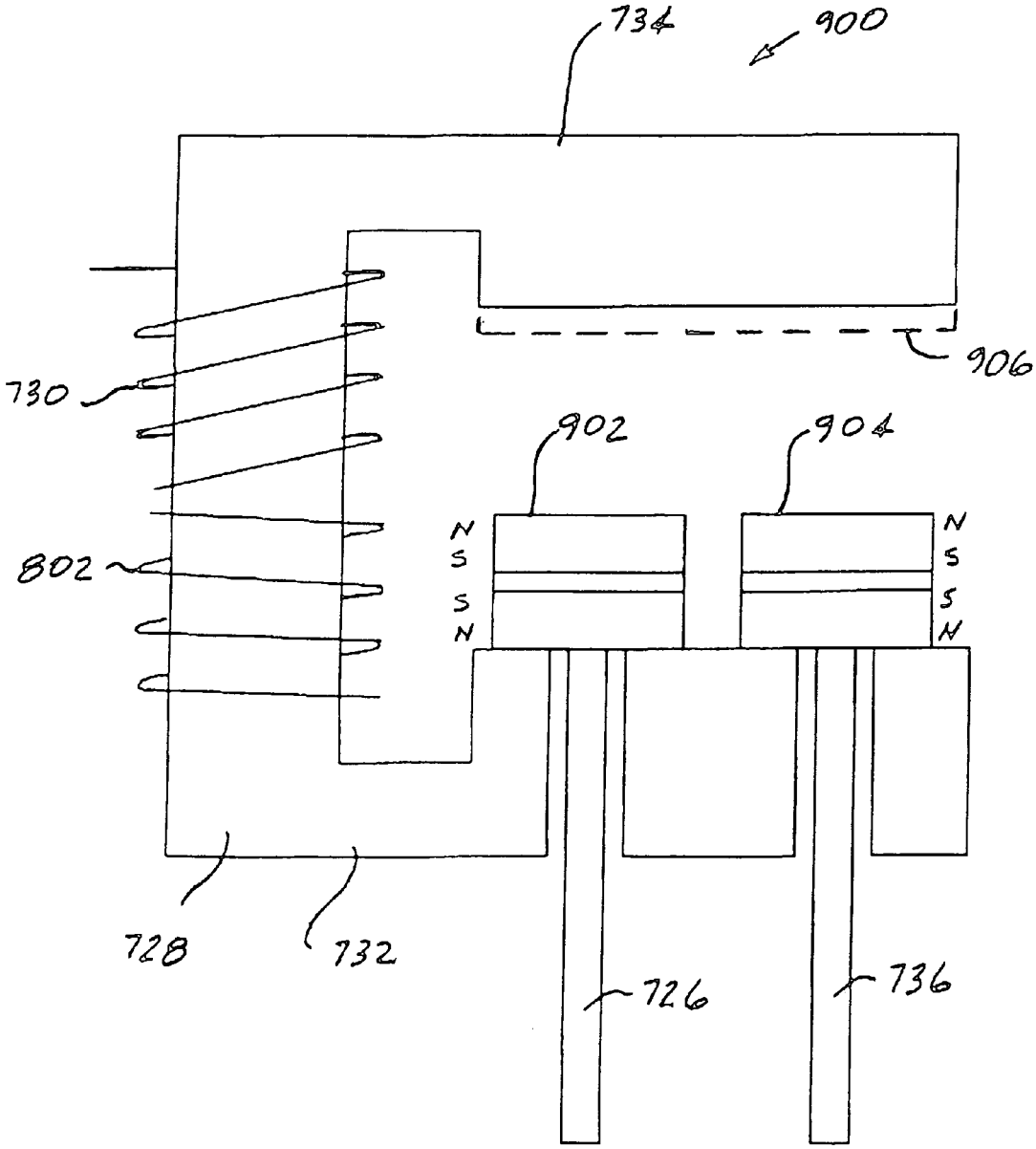
FIG. 10 is a schematic view of a tenth embodiment of the present invention.

FIG. 10 shows a tenth embodiment of the invention 900 which is generally similar to the embodiments 700 and 800 which are shown in FIGS. 8 and 9 with the exception that the magnet assemblies 902, 904 are of the same polarity. The magnet assemblies 902, 904 thus form a dual actuator or parallel actuator with the magnet assemblies 902, 904 both moving in the same direction. Details of construction of the embodiment 900 other than the polarity of the magnet assemblies 902, 904 are as previously described.

Figure 11:
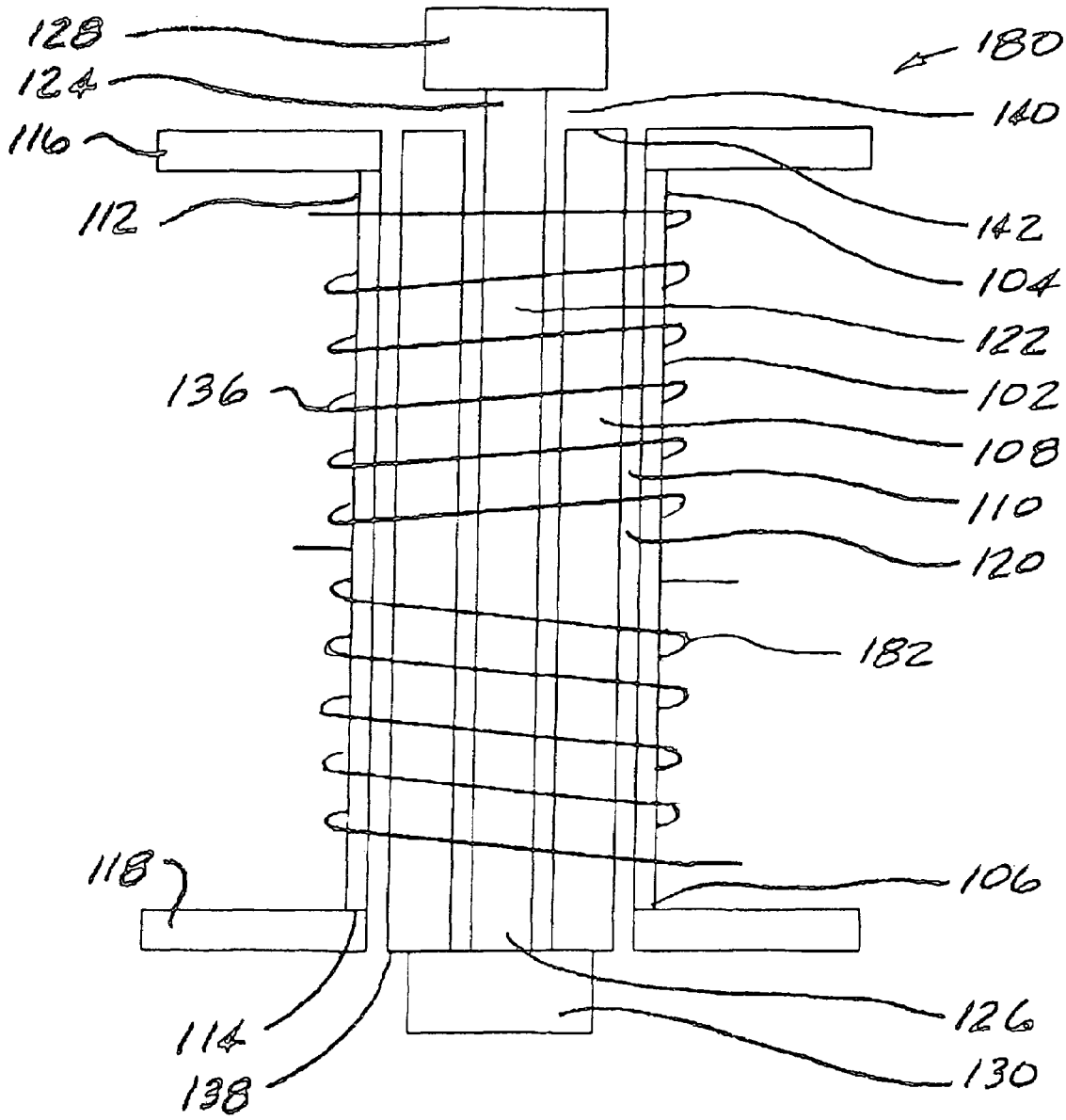
FIG. 11 is a schematic view of an eleventh embodiment of the present invention.

FIG. 11 is a schematic diagram of an eleventh embodiment of the invention 180 which is identical to the embodiment 100 of FIG. 2 with the exception that a second coil 182 has been wound on the bobbin 102. The coil 182 is wound of opposite hand to the coil 136 and energization of the coil 182 drives the embodiment 180 to the second configuration, previously described thereby eliminating the need to reverse the current.

In each of the embodiments an adjustable movement of the plunger motion may be accomplished by adjusting the poles closer or farther apart to produce a different size gap as indicated, typically, by the broken line 906 in FIG. 10. The latching force which results from the permanent magnet being attracted to either of the two pole members may be varied by changing the spacing between the magnet and the poles.

Figure 12:
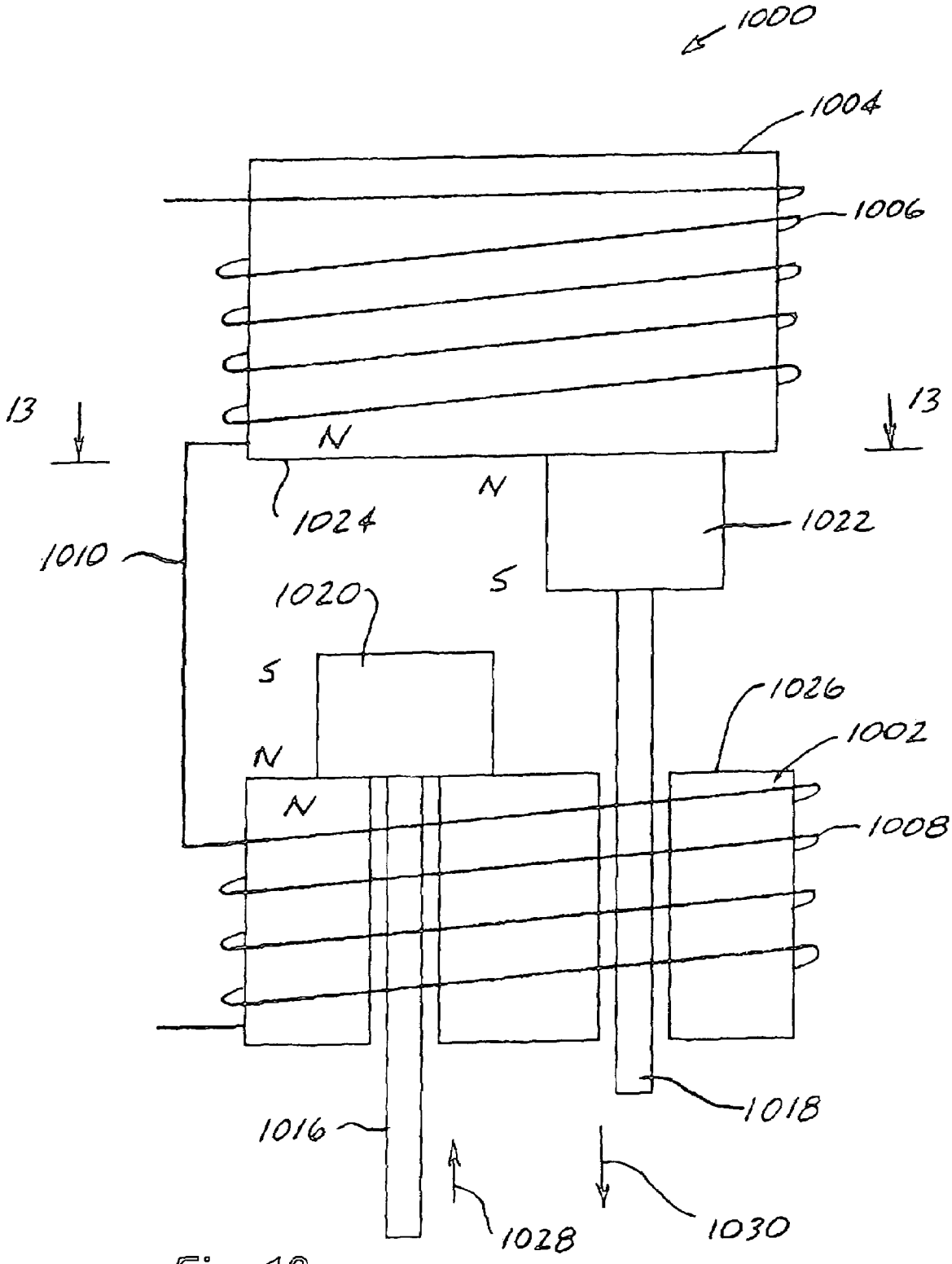
FIG. 12 is a schematic view of a twelfth embodiment of the present invention.
Figure 13:
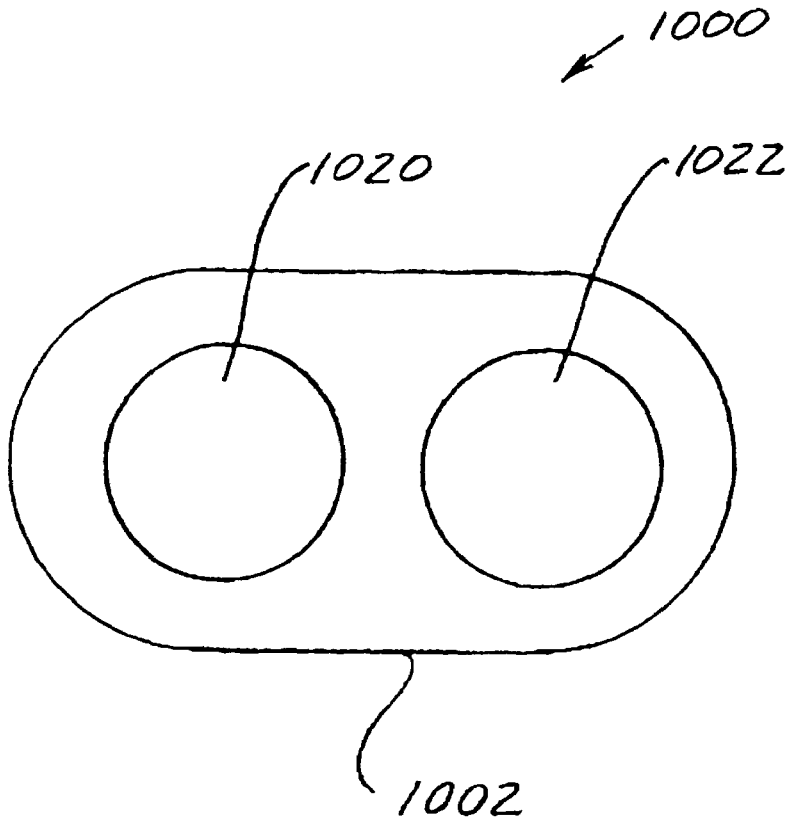
FIG. 13 is a fragmentary sectional view taken along the line 13-13 of FIG. 12.

FIGS. 12 and 13 show a twelfth embodiment 1000 of the invention in which a pair of individual pole members 1002, 1004 are provided. Coils 1006, 1008 are wound on the pole members 1002, 1004, respectively and the coils 1006, 1008 are connected by a line 1010. The lower pole member 1002 includes bores 1012, 1014 which support a pair of plungers 1016, 1018 in a sliding relationship. Each of the plungers 1016, 1018 is connected to a permanent magnet 1020, 1022. The polarity of the permanent magnets are opposite to each other as indicated by the North (N) and South (S) indications in FIG. 12. Energization of the coils 1006, 1008 results in forming an electromagnet with the North pole (N) polarity on the surfaces 1024 and with North pole (N) polarity on surface 1026 as shown in FIG. 12 with the result that the plungers 1016, 1018 move opposite to each other creating a see-saw effect as illustrated by the arrows 1028, 1030.

Figure 14:
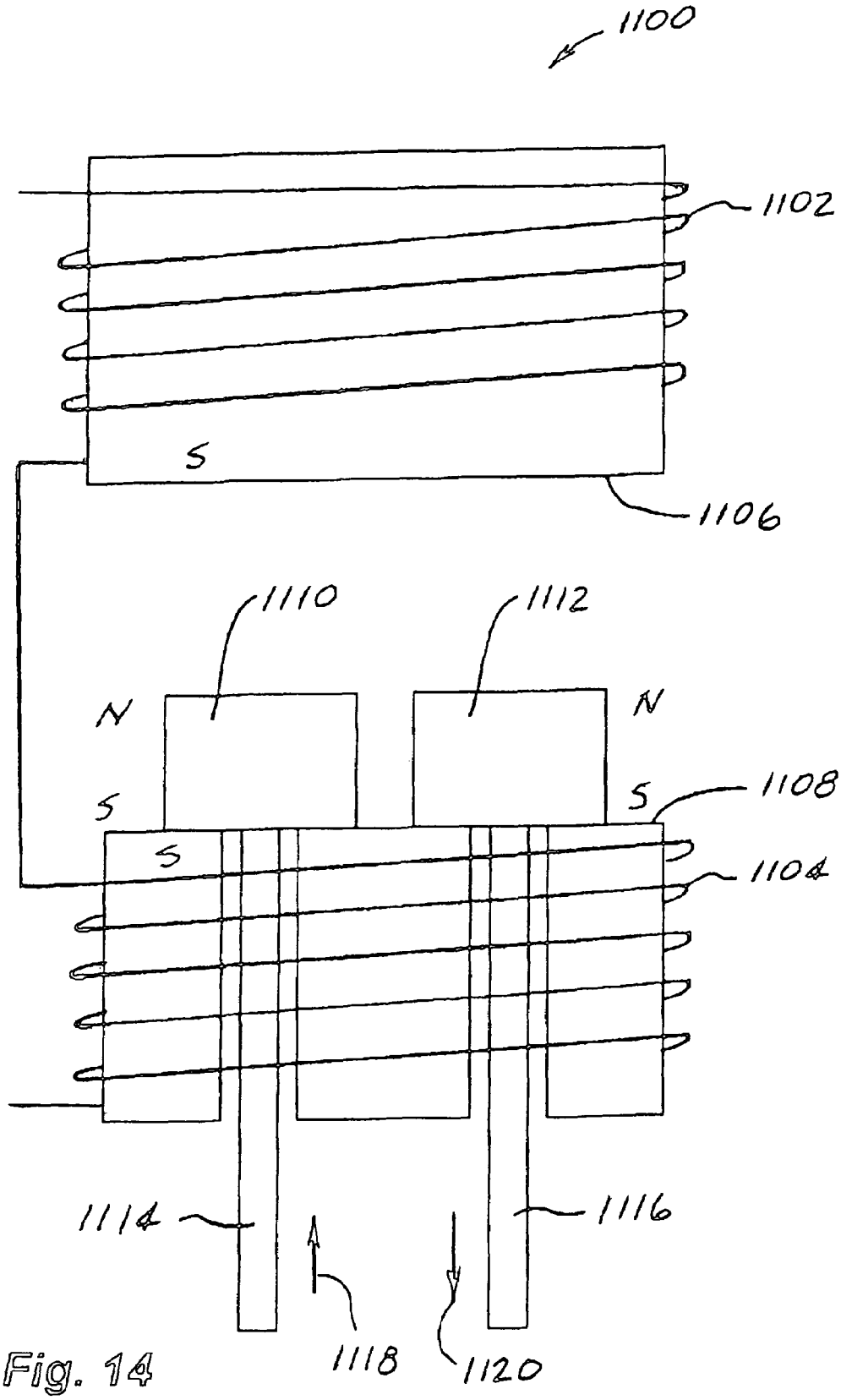
FIG. 14 is a schematic view of a thirteenth embodiment of the present invention.

FIG. 14 shows a thirteenth embodiment 1100 which is identical to the embodiment 1000 shown in FIG. 12 with the exception that the current in the coils 1102, 1104 forms south poles on the surfaces 1106, 1108 illustrated by the letter S and the orientation of the permanent magnets 1110, 1112 has been changed so that the North poles (N) of both permanent magnets 1110, 1112 face in an upward direction. As a result both plungers 1114, 1116 move in the same direction as illustrated by the arrows 1118, 1120 in FIG. 14.

The foregoing specific embodiments of the present invention as set forth in the specification herein are for illustrative purposes only. Various deviations and modifications may be made within the spirit and scope of this invention without departing from the man theme thereon.

What is claimed is:

1. A linear solenoid, comprising:

a) a hollow bobbin having a first end and a second end;

b) a first pole member disposed within said hollow bobbin, proximate to said first end of said hollow bobbin;

c) a second pole member disposed within said hollow bobbin, proximate to said second end of said hollow bobbin, with said first and said second pole members spaced-apart;

d) a plunger slidably mounted relative to said pole members, with said plunger having a first end and a second end;

e) a first electro-magnet coil disposed on said bobbin;

f) a first permanent magnet mounted on said plunger, with said first permanent magnet attracted and latched to a selected one of said pole members until said first electro-magnet coil is energized so as to allow said permanent magnet to be repelled from said selected one of said pole member and be attracted and latched to the previously unselected pole member;

g) a first flange, with said first flange connected to said first end of said bobbin;

h) a second flange, with said second flange connected to said second end of said bobbin; and i) a second electro-magnet coil, with said second electro-magnet coil disposed on said bobbin;

wherein said bobbin is free of flanges between said first flange and said second flange.

2. The linear solenoid as claimed in claim 1 further comprising:

a second permanent magnet with said second permanent magnet mounted on said plunger.

3. The linear solenoid as claimed in claim 1, wherein said bobbin is cylindrical.

4. The linear solenoid as claimed in claim 1, wherein the spacing between said first and said second pole members may be varied to produce resulting plunger stroke variation.

5. The linear solenoid as claimed in claim 1, wherein the latching force of said solenoid may be adjusted by adjusting the relative space between said first permanent magnet and said first and said second pole members.

* * * * *